US009496655B1

(12) United States Patent
Huang et al.

(10) Patent No.: US 9,496,655 B1
(45) Date of Patent: Nov. 15, 2016

(54) HIGH-FREQUENCY ELECTRONIC CONNECTOR

(71) Applicant: SPEED TECH CORP., Taoyuan (TW)

(72) Inventors: Kuo-Hua Huang, Taoyuan (TW); I-Ting Hsieh, Taoyuan (TW); Chien-Yu Hsu, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 15/092,595

(22) Filed: Apr. 6, 2016

(30) Foreign Application Priority Data

May 15, 2015 (TW) ..... 104207608 U

(51) Int. Cl.
*H01R 13/648* (2006.01)
*H01R 13/6585* (2011.01)
*H01R 13/6461* (2011.01)

(52) U.S. Cl.
CPC ..... *H01R 13/6585* (2013.01); *H01R 13/6461* (2013.01)

(58) Field of Classification Search
CPC ..... H01R 13/6594
USPC ..... 439/607.07, 607.11, 607.06
See application file for complete search history.

(56) References Cited

U.S. PATENT DOCUMENTS 8,480,413 B2 * 7/2013 Minich ..... H01R 12/724 439/607.05
8,968,031 B2 * 3/2015 Simmel ..... H01R 13/659 439/108

FOREIGN PATENT DOCUMENTS

TW M440572 U 11/2012

* cited by examiner

*Primary Examiner* — Phuong Dinh
(74) *Attorney, Agent, or Firm* — CKC & Partners Co., Ltd.

(57) ABSTRACT

A high-frequency electronic connector includes an insulating main body, a terminal module and a metal shielding plate. The insulating main body includes a matching portion and a mounting portion. The terminal module includes signal terminals and grounding terminals. Each of the signal terminals and the grounding terminals has a docking portion, a main body portion, and a trailing portion. The docking portions extend out of the matching portion and are aligned in two opposite rows. The trailing portions extend out of the mounting portion. The main body portions are fixed on the insulating main body. The main body portion of each of the grounding terminals has a notch. The metal shielding plate is disposed at the notches and electrically connected with the grounding terminals. The metal shielding plate is located between the two opposite rows of the signal terminals.

9 Claims, 16 Drawing Sheets

21

2

HIGH-FREQUENCY ELECTRONIC CONNECTOR

RELATED APPLICATIONS

This application claims priority to Taiwan Application Serial Number 104207608, filed May 15, 2015, which is herein incorporated by reference.

BACKGROUND

1. Technical Field

The present disclosure relates to a high-frequency electronic connector. More particularly, the present disclosure relates to a high-frequency electronic connector designed and assembled by the utilization of a insulating main body, a terminal module and at least one metal shielding plate.

2. Description of Related Art

Since the volume of information transmitted between most of the electronic devices has been increasing, in order to provide more friendly experience to users, the speed of information transmission between the electronic devices is accordingly increased. In order to allow the users to transmit a large volume of electronic information within an even shorter period of time, in addition to increasing the paths for transmitting electronic signals between the electronic devices, a common method adopted nowadays is to increase the frequency of the electronic signals transmitted between the electronic devices. However, under the trend of minimization of the electronic devices, the high-frequency signals are likely to cause crosstalk, causing the high-frequency electronic signals originally transmitted to generate noises. Therefore, under the situation that the frequency of the electronic signals mutually transmitted between different electronic devices is continuously increased, the adverse effect to the high-frequency electronic signals by the connector also should be considered when the high-frequency electronic signals pass through the connector. Consequently, the reason adverse to the transmission of the high-frequency electronic signals should be controlled or appropriate methods should be adopted to reduce the substantial influence, such that the high-frequency electronic signals can be completely transmitted between the electronic devices.

A general high-frequency electronic connector utilizes a metal shell to cut off the interference of the electromagnetic waves inside and outside the high-frequency electronic connector, and a conducting terminal to conduct the high-frequency noise inside the high-frequency electronic connector to the grounding circuit, so as to reduce the adverse effect of the high-frequency noise to the transmission of the high-frequency electronic signals.

Reference is made to FIGS. 1-2. FIG. 1 is a schematic perspective view showing an electrical connector according to Taiwan patent No. M440572. FIG. 2 is a partially perspective view of the electrical connector of FIG. 1. FIGS. 1-2 disclose a electrical connector A, an upper socket B, a lower socket C, a plurality of electrical contacts D, a conducting plate E, a third base plate F, a grounding common part G and two complementary electrical components H (i.e., connectors which can dock with the upper socket B and the lower socket C). In this Taiwan patent reference, the upper socket B and the lower socket C of the electrical connector A are independent of each other, and the complementary electrical components H can match with one of the sockets selectively. Since the upper socket B and the lower socket C are two connectors independent of each other, the upper socket B and the lower socket C can transmit independent high-frequency electronic signals respectively with the complementary electrical component H.

When the upper socket B, the lower socket C and the complementary electrical components H are used to transmit high-frequency electronic signals, the high-frequency electronic signals are transmitted from the electrical contacts D to the third base plate F, and the grounding route of the conducting plate E is electrically connected to the grounding circuit of the third base plate F. In Taiwan patent No. M440572, in order to avoid the interference of the electromagnetic waves respectively produced by the upper socket B and the lower socket C during the transmission of signals, the grounding common part G is disposed between the upper socket B and the lower socket C, as shown in FIG. 2.

However, although this method can cut off the interference of the electromagnetic waves between the upper socket B and the lower socket C in the electrical connector A, this design does not have the suppression effect to the electromagnetic interference among the electrical contacts D inside a single connector, especially with respect to those electrical contacts D aligned in opposite positions. When the electrical contacts D are aligned in opposite positions, the distance between the electrical contacts D are decreased, and the part of material parallel with each other is increased, thus easily resulting in the mutual electromagnetic interference. The prior art cannot solve this long existing technical problem in the industry. Furthermore, the design and structure of the electrical connector A are complicated, and the notch connected by the conducting plate E and the grounding common part G is designed in the shape of serration. Such a design leads to a complicated manufacturing and machining process, which is disadvantageous to automatic mass production, and thus needs to be improved.

SUMMARY

A technical aspect of the present disclosure is to provide a high-frequency electronic connector. More particularly, the present disclosure relates to a high-frequency electronic connector designed and assembled by the utilization of a insulating main body, a terminal module and at least one metal shielding plate, such that the present disclosure can provide a single high-frequency electronic connector with a good shielding effect and a good electromagnetic isolation effect.

According to an embodiment of the present disclosure, a high-frequency electronic connector includes an insulating main body, a terminal module and at least one metal shielding plate. The insulating main body includes a matching portion and a mounting portion. The terminal module includes signal terminals and grounding terminals, in which each of the signal terminals and the grounding terminals has at least one docking portion, a main body portion, and at least one trailing portion. Each of the docking portions extends out of the matching portion, and the docking portions are arranged in two opposite rows, such that each of the docking portions of the terminal module can establish a state of electrical connection with a docking connector. Each of the trailing portions extends out of the mounting portion. Each of the main body portions is fixed on the insulating main body, in which the main body portion of each of the grounding terminals has at least one notch. The metal shielding plate is disposed at each of the notches and electrically connected with the grounding terminals, and the metal shielding plate is located between the two opposite rows of the signal terminals.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
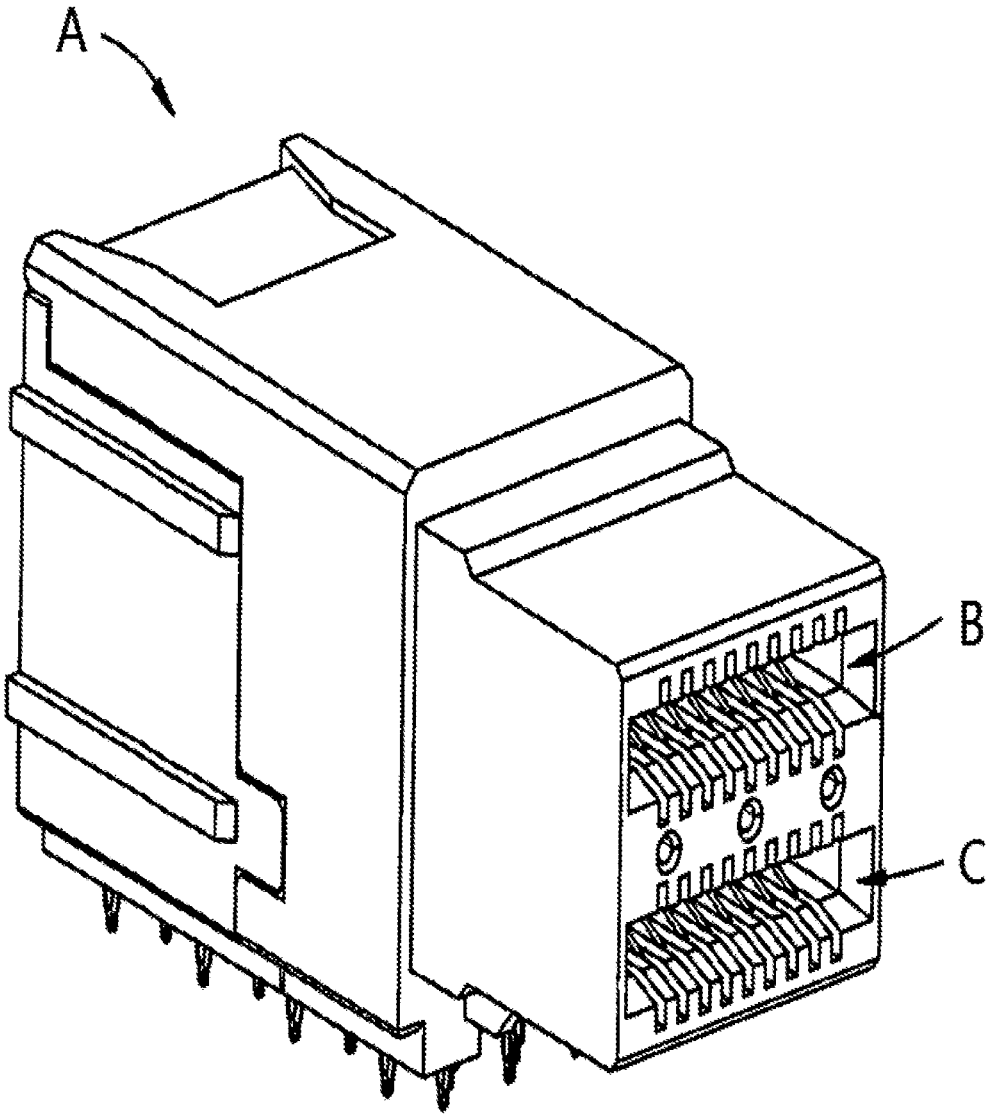
Fig. 1 ( PRIOR ART )
FIG. 1 is a schematic perspective view showing an electrical connector according to Taiwan patent No. M440572.
Figure 2:
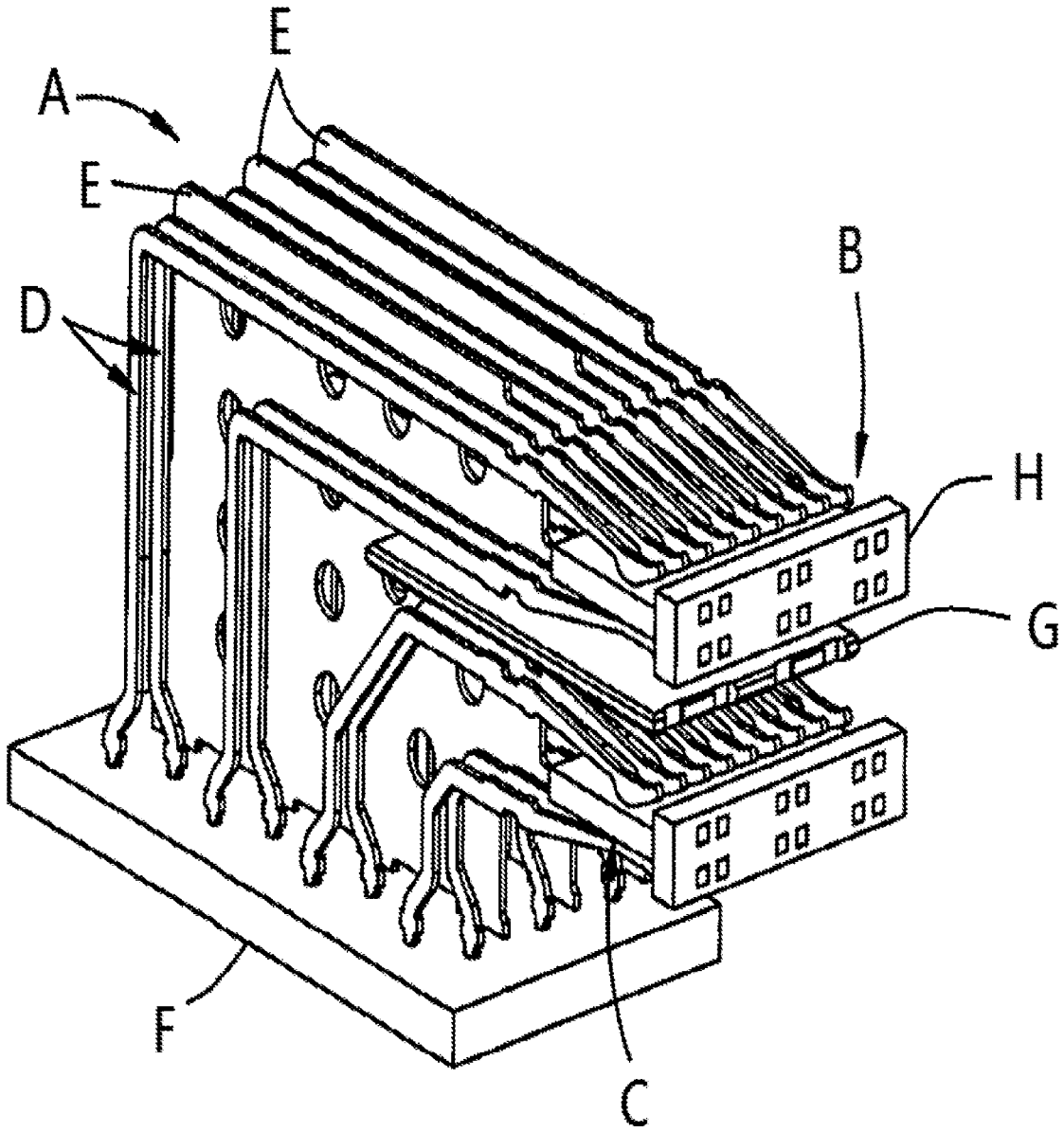
Fig. 2 ( PRIOR ART )
FIG. 2 is a partially perspective view of the electrical connector of FIG. 1.
Figure 3:
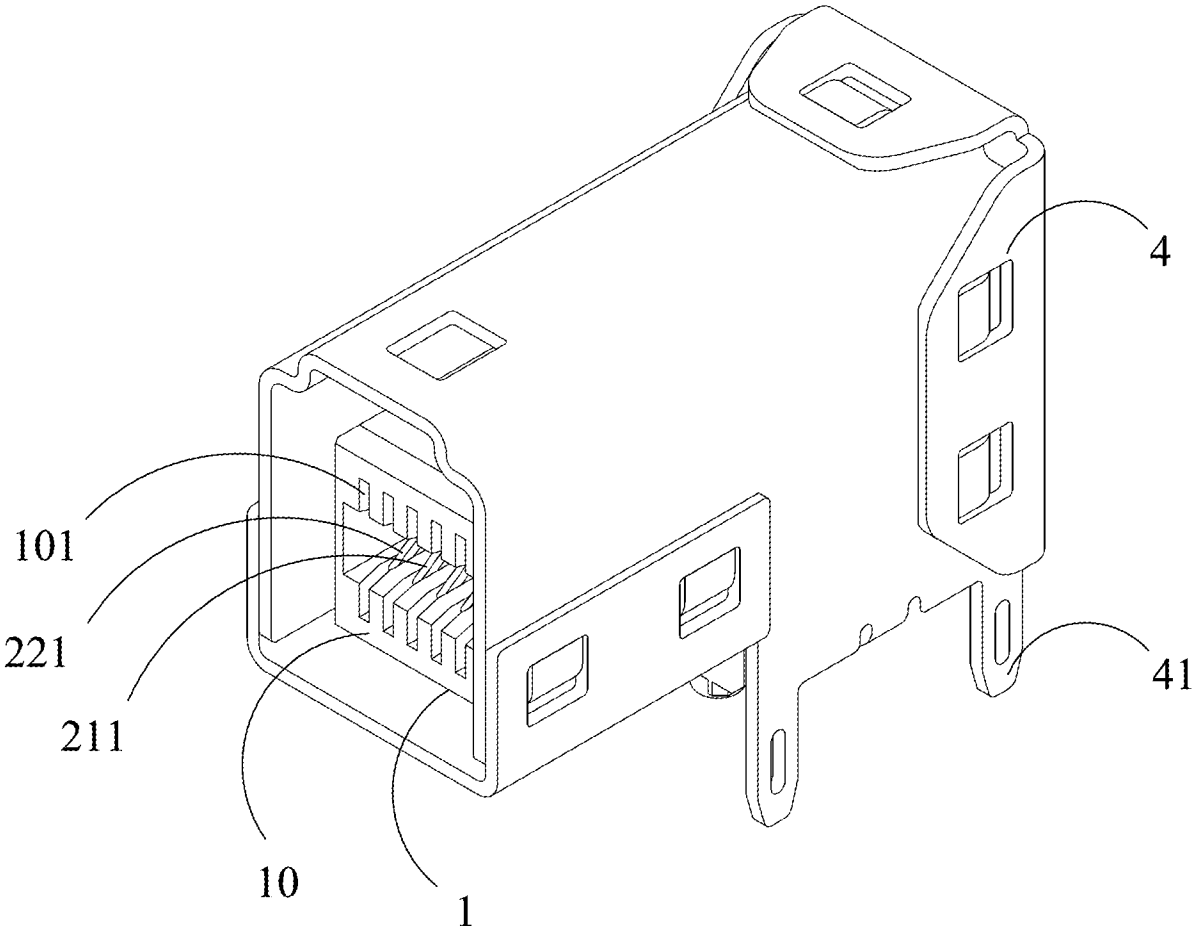
FIG. 3 is a schematic perspective view showing a high-frequency electronic connector according to a first embodiment of the present disclosure.
Figure 4:
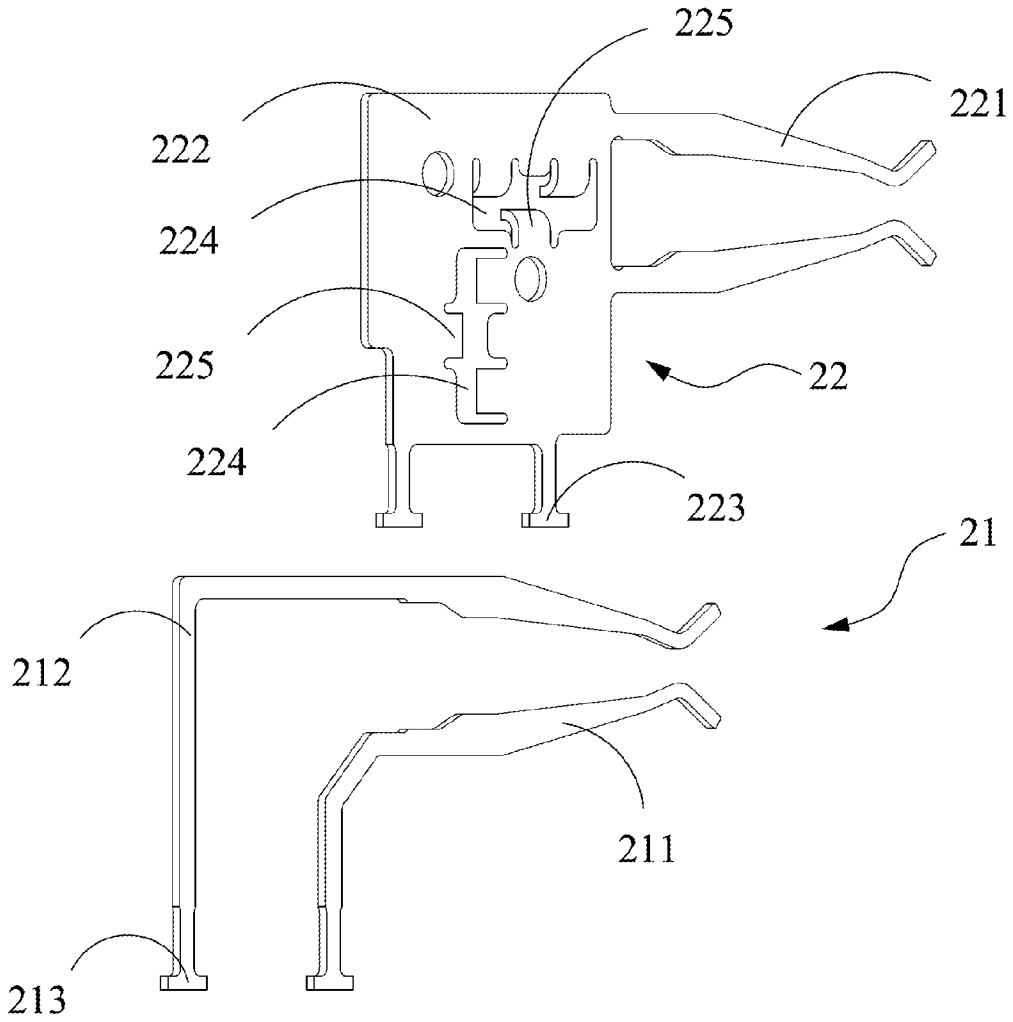
FIG. 4 is a partially perspective view of the high-frequency electronic connector of FIG. 3.
Figure 5:
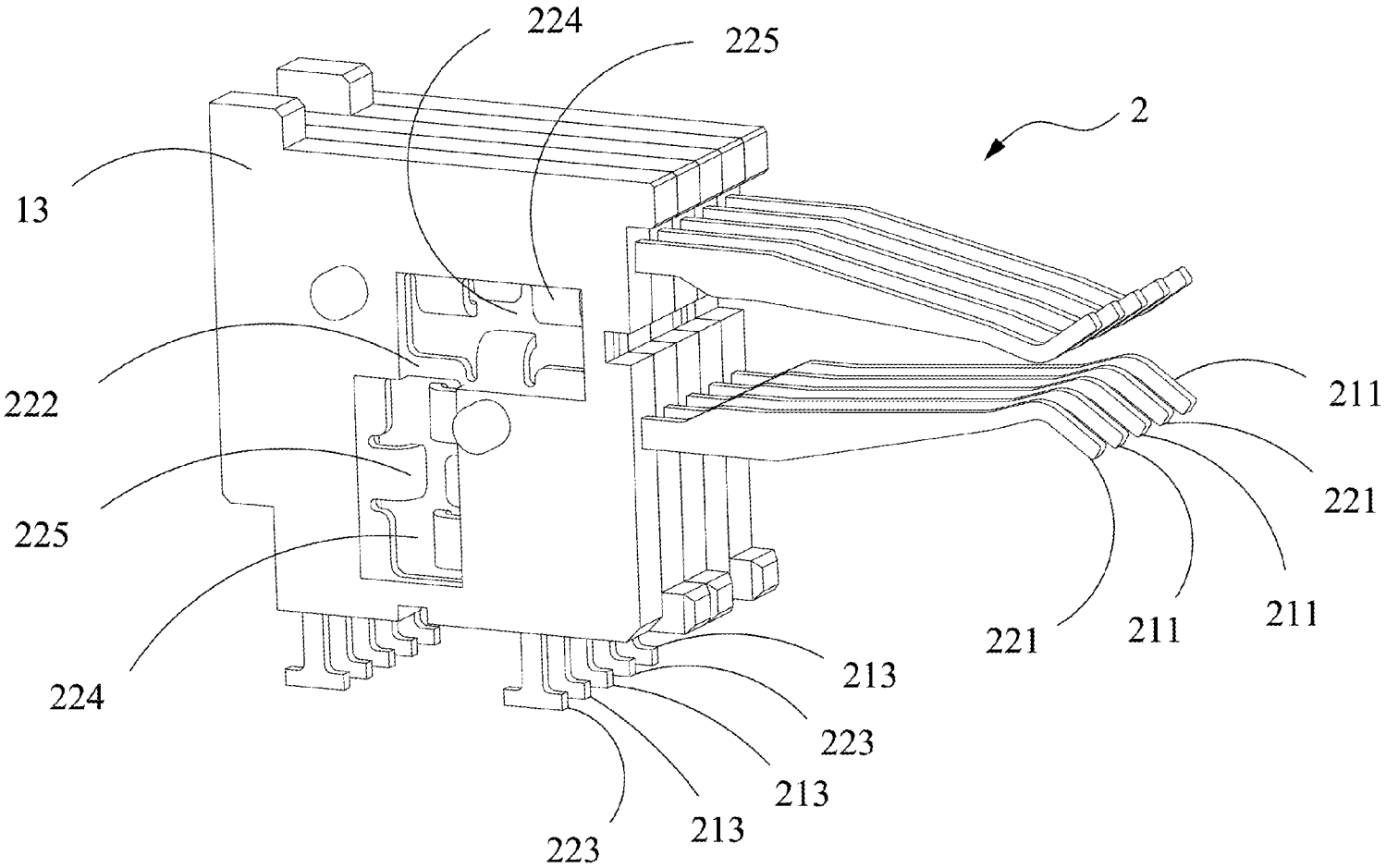
FIG. 5 is a partially perspective view of the high-frequency electronic connector of FIG. 3.
Figure 6:
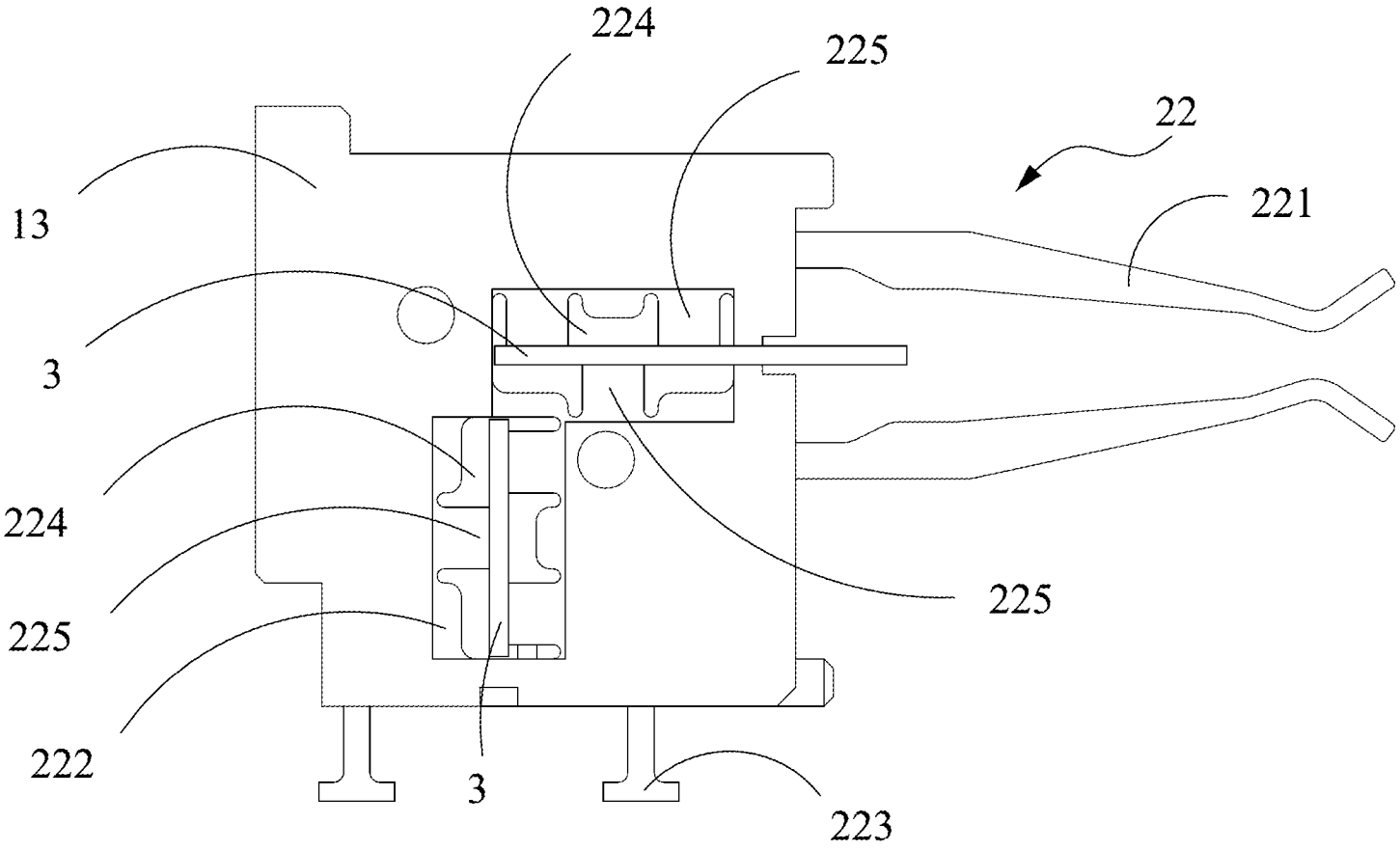
FIG. 6 is a partially perspective view of the high-frequency electronic connector of FIG. 3.
Figure 7:
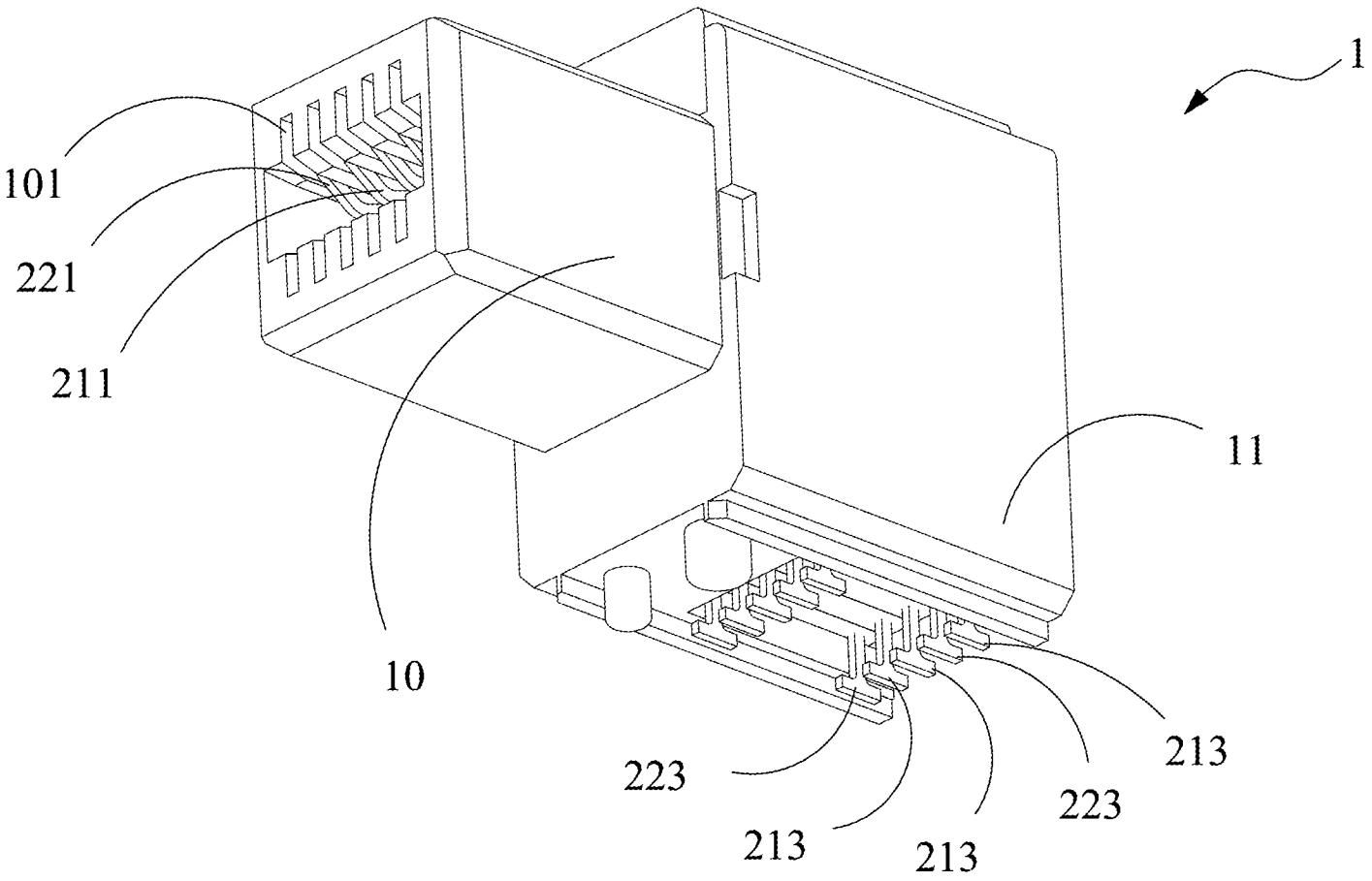
FIG. 7 is a partially perspective view of the high-frequency electronic connector of FIG. 3.
Figure 8:
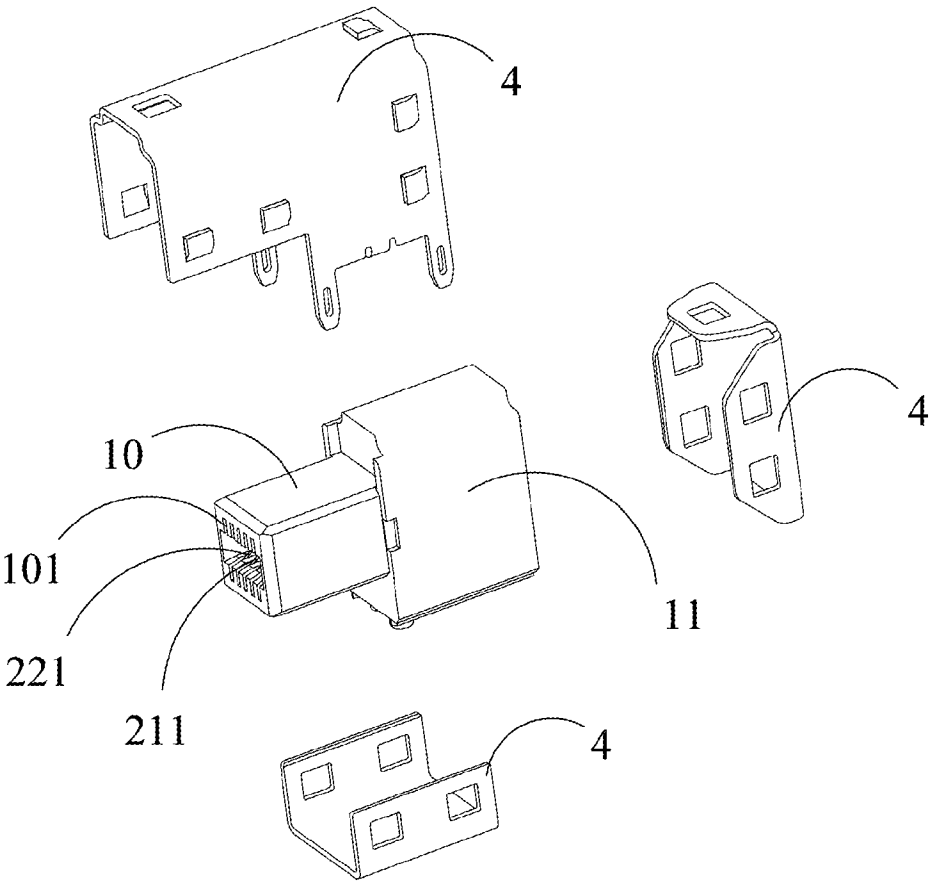
FIG. 8 is a partially perspective view of the high-frequency electronic connector of FIG. 3.

Drawings will be used below to disclose a plurality of embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As shown in FIGS. 3-8, a high-frequency electronic connector includes an insulating main body 1, a terminal module 2 and two shielding plates 3. The insulating main body 1 includes a matching portion 10 and a mounting portion 11. The matching portion 10 of the insulating main body 1 is close to a position corresponding to a docking connector (not shown).

The terminal module 2 includes a plurality of signal terminals 21 and a plurality of grounding terminals 22, in which each of the signal terminals 21 has at least one docking portion 211, a main body portion 212 and at least one trailing portion 213, and each of the grounding terminals 22 has at least one docking portion, 221, a main body portion 222, and at least one trailing portion 223. Each of the docking portions 211 and 221 extends out of the matching portion 10, and the docking portions 211 and 221 are arranged and aligned in two opposite rows. Each of the trailing portions 213, 223 extends out of the mounting portion 11 of the insulating main body 1 away from the matching portion 10 of the insulating main body 1. Each of the main body portions 212 and 222 of each of the signal terminals 21 and the grounding terminals 22 is fixed on a predetermined position of the insulating main body 1. For fixing the signal terminals 21 and the grounding terminals 22 on the predetermined position of the insulating main body 1, in the embodiment of the present disclosure, the signal terminals 21 of different rows with the docking portions 211 aligned at opposite positions are positioned and fixed together at a carrier 13, and each of the grounding terminals 22 is fixed at the independent carriers 13. By fixing each of the carriers 13 on the appropriate position of the insulating main body 1, each of the signal terminals 21 and each of the grounding terminals 22 are positioned and fixed on the appropriate positions of the insulating main body 1.

In this embodiment, the main body portion 222 of each of the grounding terminals 22 has a notch 224. Each of the notches 224 is at a point of the main body portion 222 of each of the grounding terminals 22 in which the material is removed. A portion of material of each of the grounding terminals 22 at least partially is extended into the notch 224, in which the portion of material extended forms at least one elastic arm 225 by folding the main body portion 222 of each of the grounding terminals 22. Each of the elastic arms 225 has a mechanical elasticity, and each of the elastic arms 225 is extended into the notches 224. The metal shielding plates 3 are respectively disposed at the notches 224 and interfere with the elastic arm 225 of the main body portion 222 of each of the grounding terminals 22 to form an electric connection.

In the embodiment of the present disclosure, when the metal shielding plates 3 and each of the grounding terminals 22 establish an electric connection, at least one of the metal shielding plates 3 (please refer to FIG. 16) is located near the docking portion 211 of each of the signal terminals 21. The metal shielding plate 3 is located between the docking portions 211 of the two rows of the signal terminals 21, and partially extends out of a terminal surface of the carrier 13. By utilizing the electromagnetic shielding effect of the metal shielding plate 3, an electromagnetic isolation of the docking portions 211 of the two rows of the signal terminals 21 oppositely aligned is made. Since each of the metal shielding plates 3 in the present disclosure is used for electromagnetic isolation, people having ordinary skill in the art may modify the two metal shielding plates 3 of the present disclosure to a single metal shielding plate 3 with a "L" shaped cross section, or use more metal shielding plates 3 for the electromagnetic isolation effect.

The aforementioned high-frequency electron connector has a shielding case 4 and the carriers 13, in which the shielding case 4 covers the exterior of the insulating main body 1, and the shielding case 4 includes a conducting portion 41. The conducting portion 41 is electrically connected to a grounding circuit (not shown) of a circuit board. In this embodiment, the shielding case 4 is assembled by various elements. Please refer to FIG. 3 for the completed assembly. Each of the carriers 13 is fixed inside the insulating main body 1, and each of the main body portions 212 and 222 is fixed inside the carriers 13.

Since the shielding case 4 covers the exterior of the insulating main body 1, the shielding case 4 can be used for isolating the mutual interference of the electromagnetic waves inside and outside the insulating main body 1, and the conducting portion 41 grounds the shielding case 4. Since grounding a high-frequency electromagnetic wave is an effective method to suppress the electromagnetic noise, people having ordinary skill in the art can establish a state of electrical connection between the metal shielding plate 3 or the grounding terminals 22 and the shielding case 4 through a suitable structure. In the figures of the present disclosure, each of the carriers 13 is an insulating layer formed on one of the main body portions 212 or 222 of the signal terminals 21 or the grounding terminals 22, and is positioned on the insulating main body 1 through an assembly procedure. However, this is merely a feasible method in the present disclosure, and people having ordinary skill in the art may omit each of the carriers 13 under certain conditions, such as increasing the interval of the signal terminals 21 or the grounding terminals 22 adjacent to each other. When each of the carriers 13 is omitted, each of the signal terminals 21 or the grounding terminals 22 can be directly positioned on the insulating main body 1.

When this embodiment is in practical operation, each of the signal terminals 21 and each of the grounding terminals 22 form the docking portions 211, 221, the main body portions 212, 222 and the trailing portions 213, 223 in a monolithic form, in which the main body portion 222 of each of the grounding terminals 22 form as a flat plate in this embodiment. The insulating layers are respectively formed outside the main body portions 212, 222 of each of the signal terminals 21 and each of the grounding terminals 22, and the carriers 13 are respectively formed at the insulating layer outside each of the signal terminals 21 and each of the grounding terminals 22. The main body portion 222 of each of the grounding terminals 22 is disposed with two notches 224 which are located close to the matching portion 10 and the mounting portion 11 respectively. A portion of material of the main body portion 222 of each of the grounding terminals 22 is extended towards each of the notches 224, and the portion of material extended bends and forms at least one elastic arm 225 by the main body portion 222 of each of the grounding terminals 22, and is then located in the notches 224. After the signal terminals 21 and the grounding terminals 22 are fixed on the carriers 13 respectively, the docking portions 211, 221 of each of the signal terminals 21 and each of the grounding terminals 22 are aligned in two transverse rows outside the terminal surface of the carriers 13 at equal intervals. The elastic arms 225 of the main body portion 222 of the grounding terminals 22 protrude in the notches 224 of the carriers 13, and the trailing portions 213, 223 of each of the signal terminals 21 and each of the grounding terminals 22 are aligned outside the mounting portion 11 at equal intervals.

The metal shielding plates 3 are formed by cutting and bending a metal thin plate, and are respectively inserted into the notches 224. The main body portion 222 of the grounding terminals 22 protrude in the notches 224 by bending the elastic arms 225, such that the metal shielding plates 3 interfere with the grounding terminals 22 to form electrical connections. In this embodiment, the electrical connections can be formed by welding. In practical applications, the electrical connections can be formed by using a simple change of structure to form contacts.

According to the present disclosure, for each of the docking portions 211, 221 of each of the signal terminals 21 and each of the grounding terminals 22 aligned in two rows of an upper row and a lower row, during the transmission of the high-frequency electronic signals, the interference of the mutual electromagnetic waves is isolated by each of the metal shielding plate 3. The docking portion 221 of each of the grounding terminals 22 can be electrically connected with the grounding terminal (not shown) of the docking connector, and meanwhile can form a grounding route with the grounding terminal of the docking connector and each of the metal shielding plates 3.

In the figures of the present disclosure, each of the carriers 13 is an insulating layer formed outside a pair of signal terminals 21 or a grounding terminal 22. The high-frequency electronic connector disclosed in the figures is a high-frequency electronic connector with a fine pitch and a high density, and thus the utilization of each of the carriers 13 is a method convenient to the production line for the assembly of final products. People having ordinary skill in the art is not required to use each of the carriers 13 as the necessary element in the present disclosure. When the people having ordinary skill in the art omits each of the aforementioned carriers 13 of the present disclosure, the main body portions 212 of each of the signal terminals 21 and the main body portions 222 of each of the grounding terminals 22 can be respectively positioned in the insulating main body 1, and each of the metal shielding plates 3 can interfere with the main body portion 222 of each of grounding terminals 22, so as to respectively fix each of the metal shielding plates 3 in the insulating main body 1. In some conditions, a structure can be disposed in the insulating main body 1 to assist positioning each of the metal shielding plates 3,such as a structure similar to the notch 224 of each of the carriers 13 in the figures.

The shielding case 4 covers the exterior of the insulating main body 1, aiming to isolate the effect of the electromagnetic waves between the inside and outside of the shielding case 4 when the insulating main body 1 is connected with the docking connector (not shown). The shielding case 4 includes a conducting portion 41 electrically connected to a grounding circuit (not shown) of a circuit board.

For the sake of simplicity, the formation of the same structures of the high-frequency electronic connector shown in FIG. 9 below and that of the first embodiment shown in FIGS. 1-8 are the same and are not to be repeatedly described herein.

Figure 9:
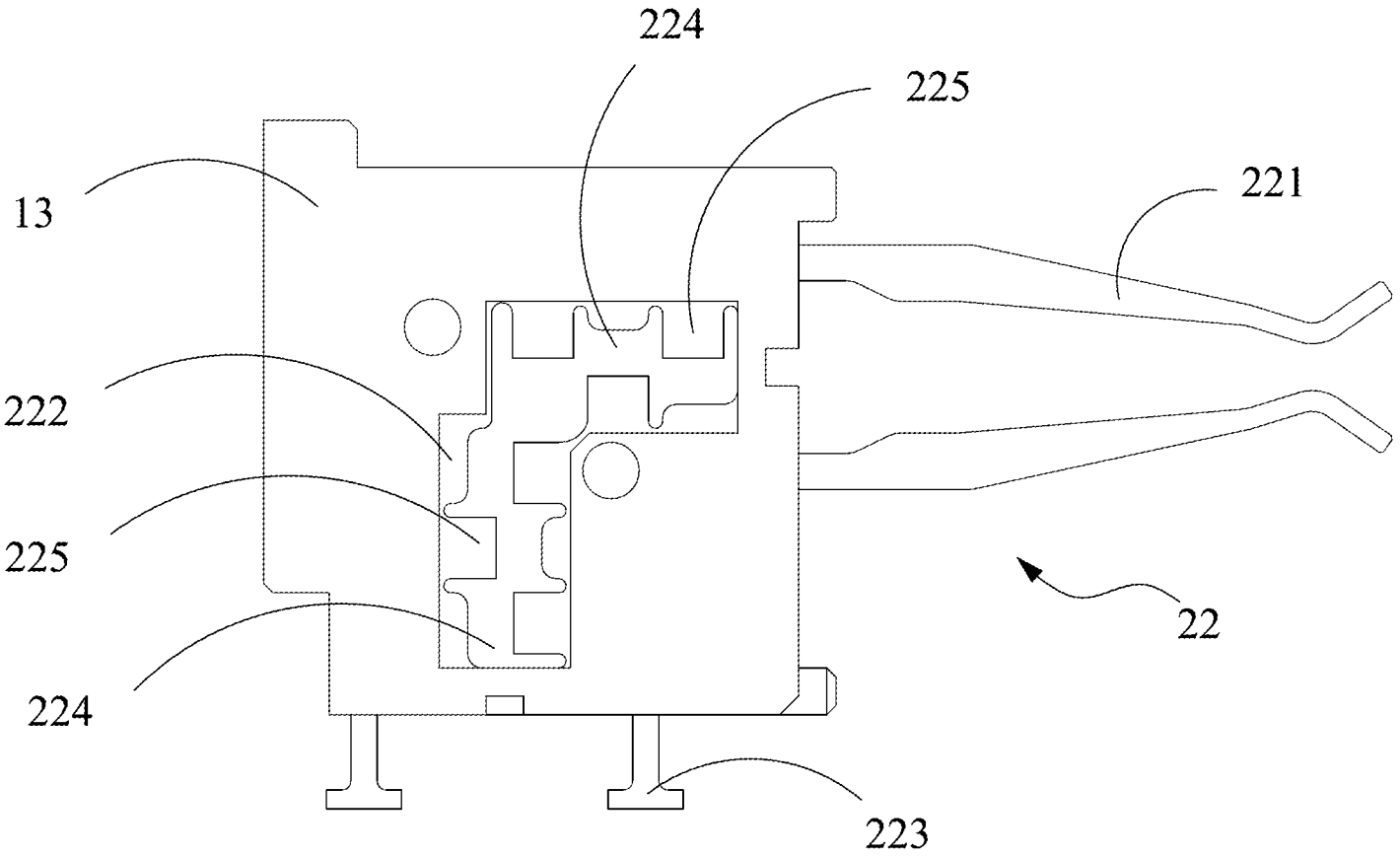
FIG. 9 is a partially perspective view of a high-frequency electronic connector according to a second embodiment of the present disclosure.
Figure 10:
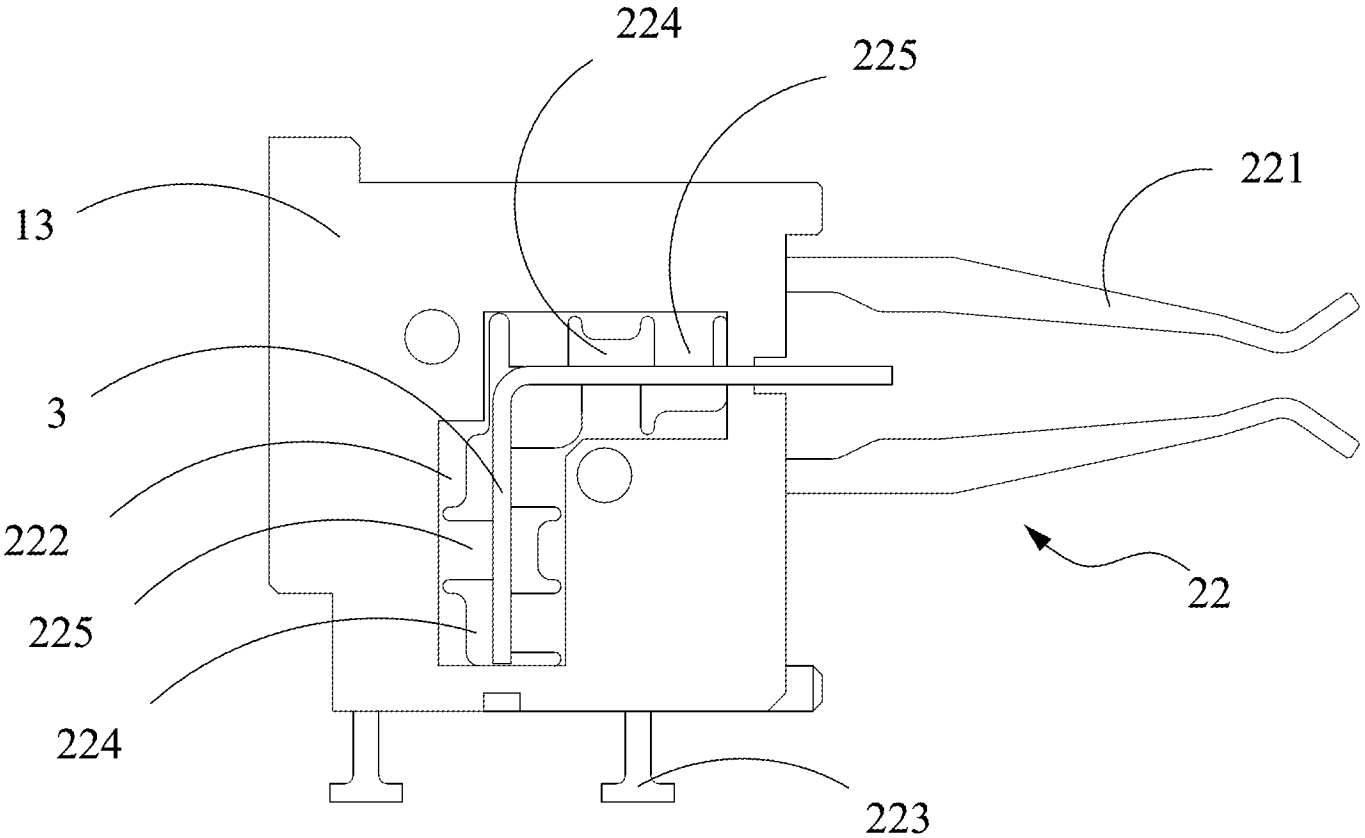
FIG. 10 is a partially perspective view of the high-frequency electronic connector of FIG. 9.
Figure 11:
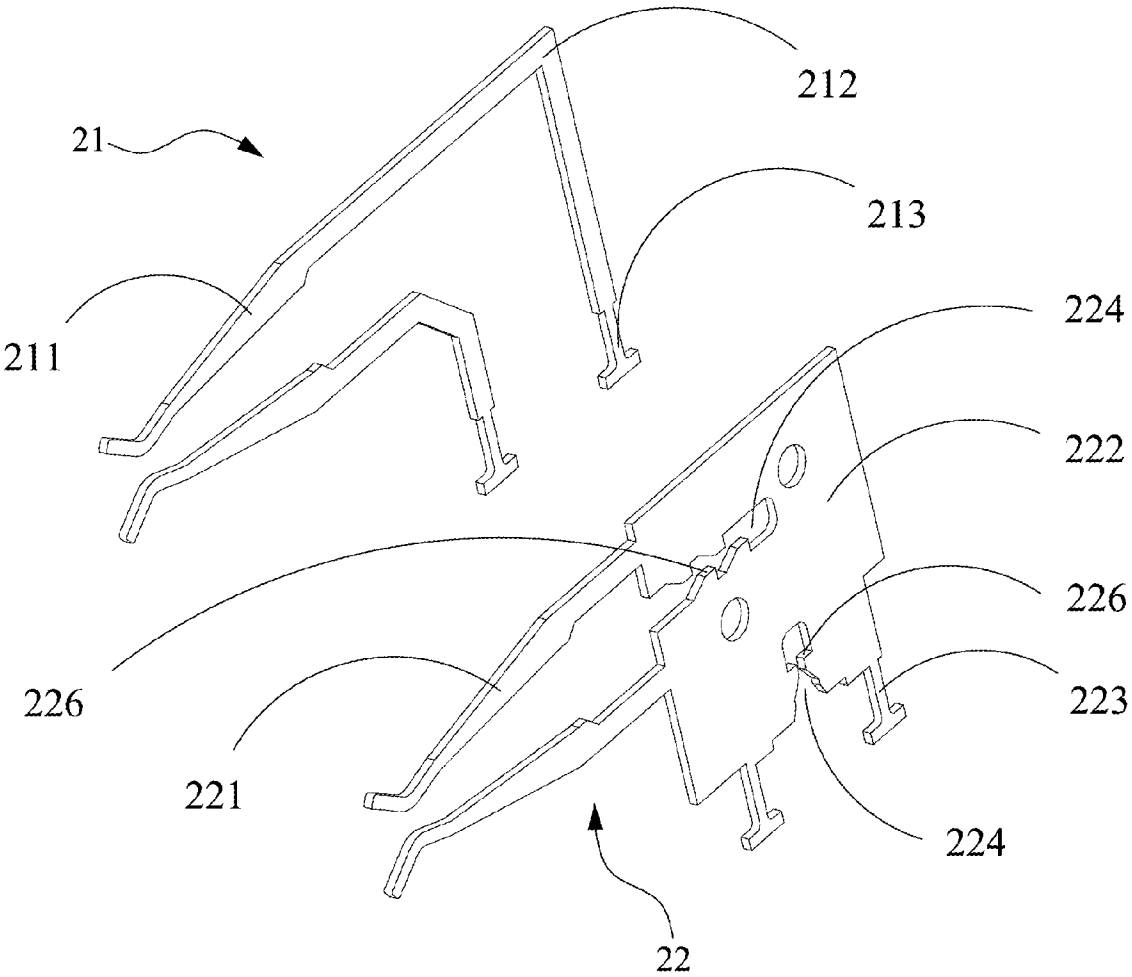
FIG. 11 is a partially perspective view of a high-frequency electronic connector according to a third embodiment of the present disclosure.
Figure 12:
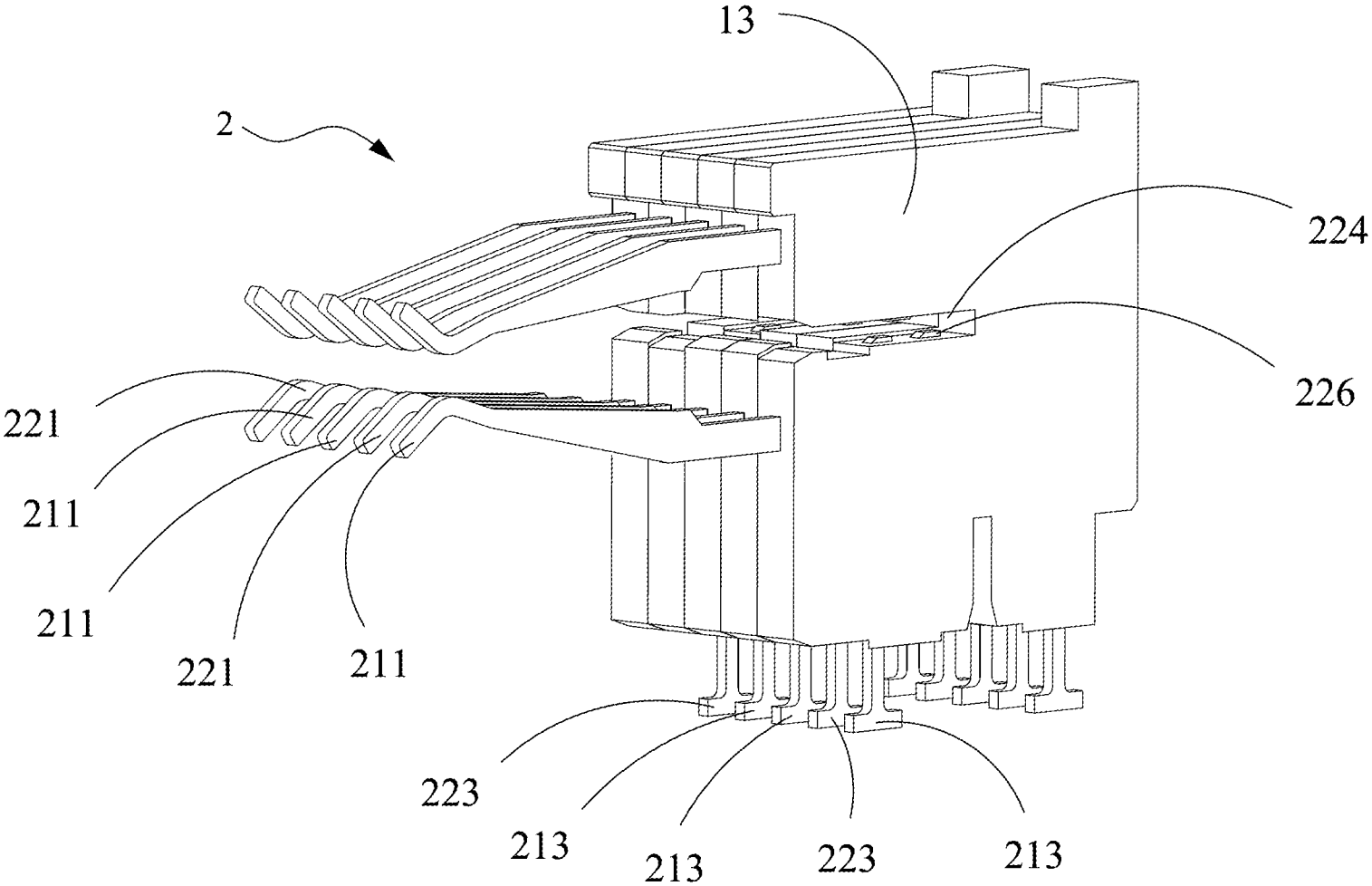
FIG. 12 is a partially perspective view of the high-frequency electronic connector of FIG. 11.
Figure 13:
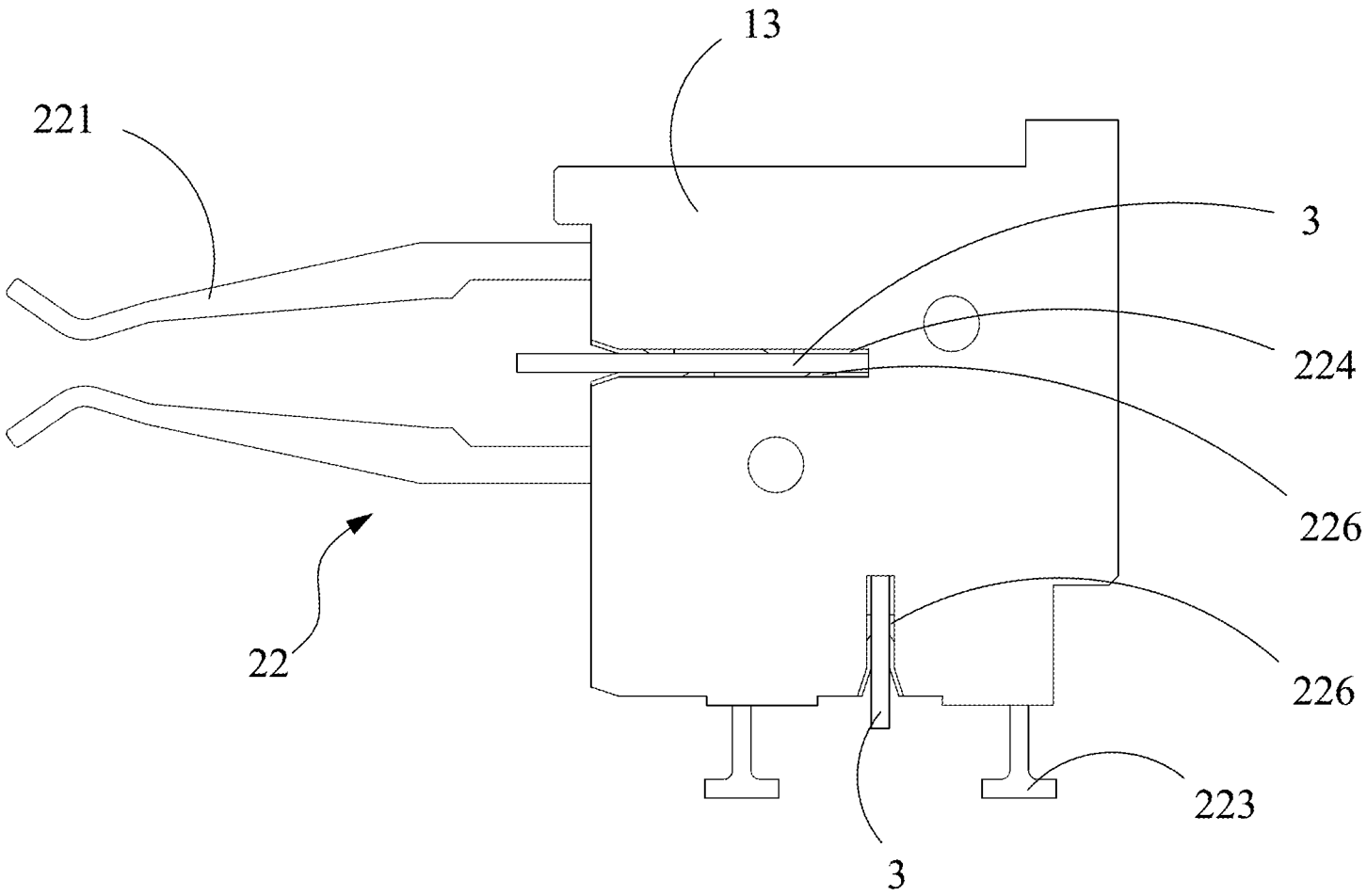
FIG. 13 is a partially perspective view of the high-frequency electronic connector of FIG. 11.
Figure 14:
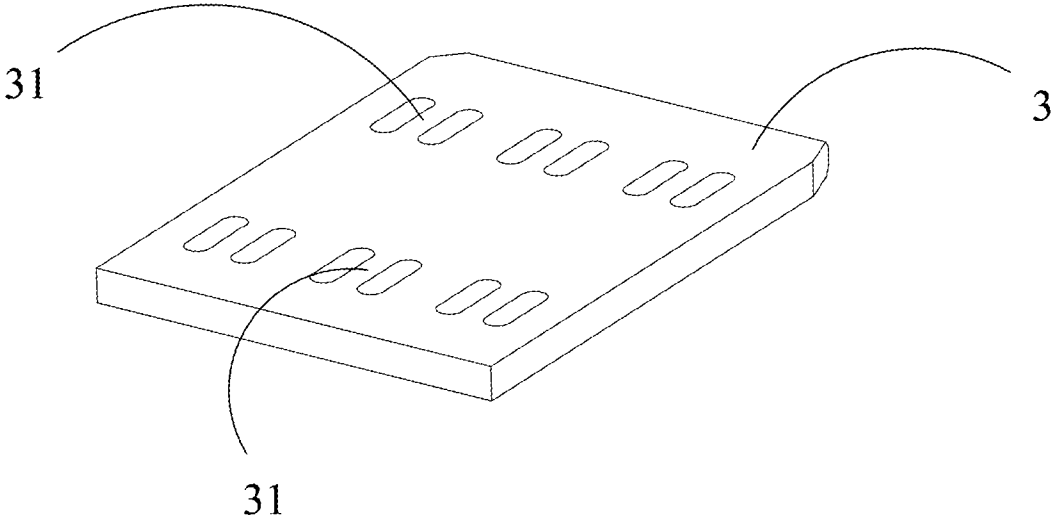
FIG. 14 is a partially perspective view of the high-frequency electronic connector of FIG. 11.

Please refer to FIGS. 9-10. FIGS. 9-10 are partially perspective views of a high-frequency electronic connector according to a second embodiment of the present disclosure. In this embodiment, the structure and the operation manner are the same as those of the first embodiment, except a difference in the structure of the notches 224. In the embodiment, the notch 224 is disposed in the carrier 13 directly in the form of "L" shape, and each of the docking portions 211, 221 extends out of the matching portion 10 and the docking portions 211, 221 are respectively arranged in two opposite rows. Each of the trailing portions 213, 223 extends out of the mounting portion 11 of the insulating main body 1 away from the matching portion 10 of the insulating main body 1. Each of the main body portions 212, 222 of each of the signal terminals 21 and the grounding terminals 22 is fixed on a predetermined position of the carriers 13, and a portion of material each of the grounding terminals 22 at least partially is extended into the notches 224, in which the portion of material extended bends and forms at least one elastic arm 225 by the main body portion 222 of each of the grounding terminals 22, and is then located in the notches 224. The metal shielding plate 3 is integrally disposed in the notches 224, and interferes with the elastic arm 225 of the main body portion 222 of each of the grounding terminals 22 to form an electrical connection, and is located between the docking portions 211 of the two rows of signal terminals 21, and partially extends out of the terminal surface of the carrier 13.

Please refer to FIGS. 11-14. FIGS. 11-14 are partially perspective views of a high-frequency electronic connector according to a third embodiment of the present disclosure. In this embodiment, the notches 224 respectively extend from the terminal surfaces of the grounding terminals 22, and can respectively accommodate at least a portion of the metal shielding plate 3. After the signal terminals 21 and the grounding terminals 22 are fixed on the carriers 13 respectively, the docking portions 211, 221 of each of the signal terminals 21 and the grounding terminals 22 are arranged in two transverse rows. The trailing portions 213, 223 of each of the signal terminals 21 and the grounding terminals 22 are arranged outside the mounting portion 11 at equal intervals. The main body portion 222 of each of the grounding terminals 22 is disposed with two notches 224 which are located close to the matching portion 10 and the mounting portion 11 respectively. A portion of material of the main body portion 222 of each of the grounding terminals 22 is extended into the notches 224. In this embodiment, the portion of material extended bend and forms at least one protruding portion 226 by the main body portion 222 of each of the grounding terminals 22 and is then located in the notches 224. In the figures of this embodiment, the effect of the mechanical elasticity of the protruding portion 226 is not obvious. Instead, the mechanical rigidity is more obvious. Thus, when the metal shielding plates 3 are inserted into the notches 224, since there is the protruding portion 226 located in the notch 224, each of the grounding terminals 22 can form a state of electrical connection with the metal shielding plates 3.

In the first and the second embodiments, a portion of the material of the main body portion 222 of each of the grounding terminals 22 is extended and then bent to form the elastic arm 225 to electrically connect with the metal shielding plate 3. In this embodiment, the main body portion 222 of each of the grounding terminals 22 protrudes in the protruding portions 226 of each of the notches 224 to interfere with the contacting portion 31 of the metal shielding plate 3 to form an electrical connection.

Figure 15:
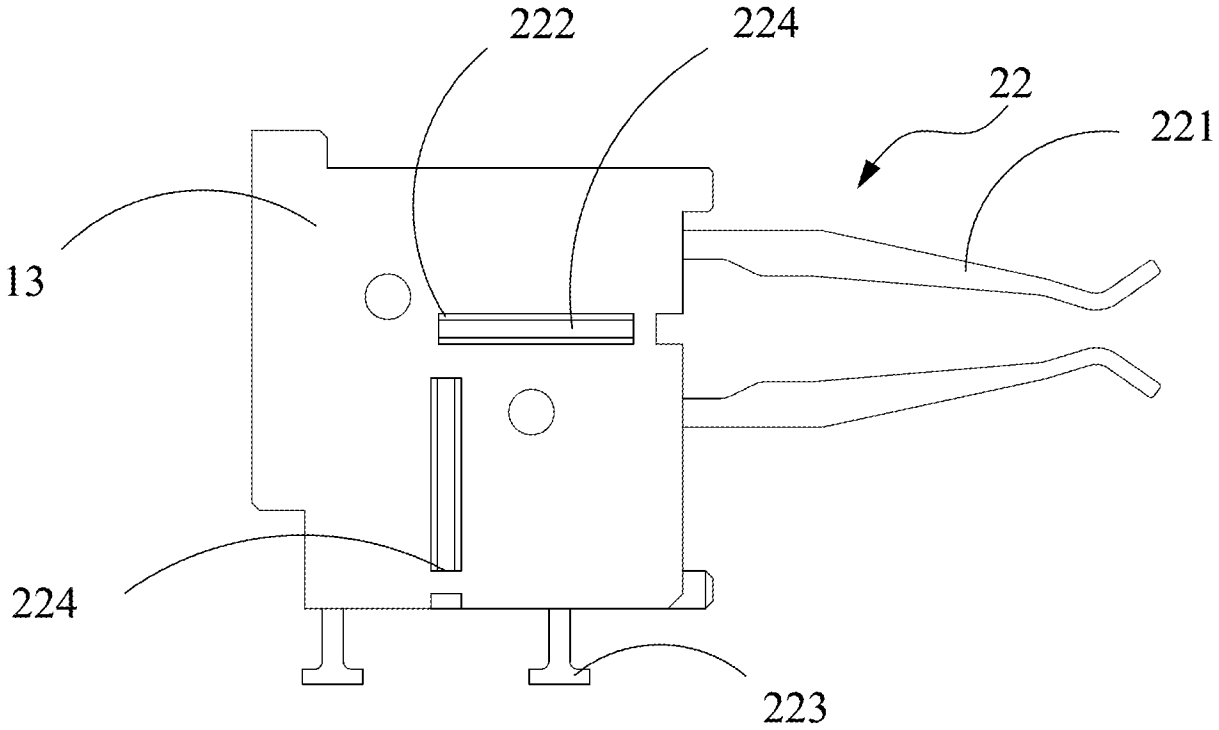
FIG. 15 is a partially perspective view of a high-frequency electronic connector according to a fourth embodiment of the present disclosure.
Figure 16:
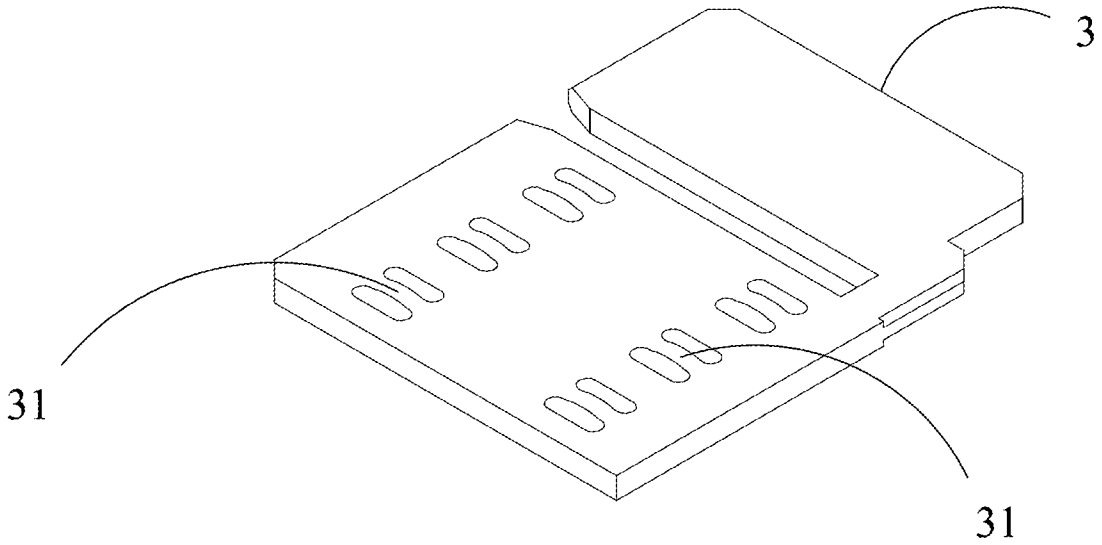
FIG. 16 is a partially perspective view of the high-frequency electronic connector of FIG. 15.

Please refer to FIGS. 15-16. FIGS. 15-16 are partially perspective views of a high-frequency electronic connector according to a fourth embodiment of the present disclosure. In the figures of this embodiment, the main body portion 222 of each of the grounding terminals 22 is disposed with two notches 224 which are located close to the matching portion 10 and the mounting portion 11 respectively. In this embodiment, the metal shielding plate 3 is machined and at least one contacting portion 31 is formed on its surface. The contacting portion 31 is a protruded portion with a mechanical rigidity in this embodiment. The protruded portion is used to contact the main body portion 222 of each of the grounding terminals 22 to form an electrical connection. After the completion of assembly of the metal shielding plate 3 and each of the grounding terminals 22 and the mutual interference, since the metal shielding plate 3 has at least one contacting portion 31 protruded and forced to interfere with an edge of the notch 224, when the metal shielding plates 3 are inserted into the notches 224, each of the grounding terminals 22 and each of the metal shielding plates 3 form a state of electrical connection. The difference between this embodiment and the third embodiment is that, in the third embodiment, the contacting portion 31 of the metal shielding plate 3 is a flat surface, in which the main body portions 222 of each of the grounding terminals 22 are used to extend material to form at least one protruding portion 226 to electrically connect with the metal shielding plate 3. In this embodiment, the metal shielding plate 3 has at least one contacting portion 31 protruded in the notches 224, electrically connecting with the main body portion 222 of each of the grounding terminals 22.

Through the aforementioned design, the insulating main body 1, the terminal module 2 and at least one metal shielding plate 3 are used to prevent the interference of the noise during the signal transmission so as to achieve a good shielding effect. The structures of each of the elements are simple and suitable for automatic production, which can reduce the manufacturing time while the production rate is increased. Thus, the conventional disadvantages of complicated manufacturing procedure and high manufacturing cost are improved.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A high-frequency electronic connector, comprising:

an insulating main body comprising a matching portion and a mounting portion;

a terminal module comprising a plurality of signal terminals and a plurality of grounding terminals, wherein each of the signal terminals and the grounding terminals has at least one docking portion, a main body portion, and at least one trailing portion, and each of the docking portions extend out of the matching portion, and the docking portions are arranged in two opposite rows, such that each of the docking portions of the terminal module establish a state of electrical connection with a docking connector; each of the trailing portions extend out of the mounting portion; and each of the main body portions is fixed on the insulating main body, wherein the main body portion of each of the grounding terminals has at least one notch; and at least one metal shielding plate disposed at each of the notches and electrically connected with the grounding terminals, wherein the metal shielding plate is located between the signal terminals which are arranged in two opposite rows.

2. The high-frequency electronic connector of claim 1, wherein the matching portion has a plurality of terminal slots, and the docking portions correspond to the terminal slots in position.

3. The high-frequency electronic connector of claim 1, wherein each of the main body portions is fixed on a corresponding carrier, and each of the carriers is fixed inside the insulating main body.

4. The high-frequency electronic connector of claim 3, wherein the main body portions of the signal terminals aligned at opposite positions are positioned together at the carrier, and are fixed together at a predetermined position of the insulating main body by the carrier.

5. The high-frequency electronic connector of claim 1, wherein the main body portion of each of the grounding terminals at least partially extends into the notch.

6. The high-frequency electronic connector of claim 1, wherein the main body portion of each of the grounding terminals is electrically connected with the metal shielding plate through at least one elastic arm.

7. The high-frequency electronic connector of claim 1, wherein the metal shielding plate has at least one contacting portion electrically connected with the notches of the grounding terminals.

8. The high-frequency electronic connector of claim 7, wherein the contacting portion forms a protrusion with a mechanical rigidity.

9. The high-frequency electronic connector of claim 1, wherein the metal shielding plate is located between the two opposite rows of the docking portions of the signal terminals.

* * * * *